US008251421B1

(12) United States Patent
Homan

(10) Patent No.: US 8,251,421 B1
(45) Date of Patent: Aug. 28, 2012

(54) PANEL CARRIER

(76) Inventor: Kevin F. Homan, Oak Ridge, TN (US)

( * ) Notice: Subject to any disclaimer, the term of this patent is extended or adjusted under 35 U.S.C. 154(b) by 0 days.

(21) Appl. No.: 13/213,286

(22) Filed: Aug. 19, 2011

(51) Int. Cl.
*A45F 5/10* (2006.01)

(52) U.S. Cl. ..... 294/153; 294/142

(58) Field of Classification Search ..... 294/15, 294/153, 26, 27.1, 137, 142; 224/578, 258, 224/268; D6/366; D8/14; D34/28
See application file for complete search history.

(56) References Cited

U.S. PATENT DOCUMENTS

| | | | | | |
|---|---|---|---|---|---|
| 2,399,786 | A | * | 5/1946 | Caton | 294/153 |
| 2,428,941 | A | * | 10/1947 | Packard | 294/169 |
| 4,098,442 | A | | 7/1978 | Moore | |
| 4,113,160 | A | | 9/1978 | Spiers | |
| 4,190,278 | A | | 2/1980 | Jancik, Jr. | |
| 4,235,355 | A | | 11/1980 | Henry et al. | |
| D317,703 | S | * | 6/1991 | Cydrus | D8/14 |
| 5,069,495 | A | | 12/1991 | Mears | |
| D349,437 | S | | 8/1994 | Mock et al. | |
| D351,769 | S | | 10/1994 | Brass et al. | |
| 5,397,158 | A | | 3/1995 | Brass et al. | |
| D412,270 | S | | 7/1999 | Fredrickson | |
| D423,309 | S | | 4/2000 | Sirmans | |
| D462,497 | S | * | 9/2002 | Talamantes | D29/101.1 |
| 6,857,673 | B2 | * | 2/2005 | Lang | 294/142 |
| D642,026 | S | * | 7/2011 | Martin | D8/14 |
| 2008/0164705 | A1 | * | 7/2008 | DuBois | 294/15 |
| 2010/0187274 | A1 | * | 7/2010 | Chock, Jr. | 224/578 |

* cited by examiner

*Primary Examiner* — Paul T Chin
(74) *Attorney, Agent, or Firm* — Luedeka Neely Group, P.C.

(57) ABSTRACT

A panel carrying device includes a flexible strap having a first end and a second and a panel receiving mechanism attached adjacent the second end of the flexible strap. The panel receiving mechanism includes a panel receiving platform for supporting a panel, the panel receiving platform having a proximal end and a distal end, and a counterbalancing portion connected to the distal end of the panel receiving platform for assisting in balancing the panel receiving platform during placement and carrying of the panel.

20 Claims, 5 Drawing Sheets

PANEL CARRIER

FIELD

This invention relates generally to a panel carrying device. More specifically, this invention relates to a compact panel carrying device having a flexible strap and a panel receiving mechanism having a counterbalancing portion for assisting in positioning a panel in the panel receiving mechanism and balancing the weight of the panel being carried.

BACKGROUND

Large panels of construction material such as drywall, plywood, sheetrock, etc. are heavy and awkward to carry. Ordinarily, a worker grasps one end of the panel with one hand and the opposite end of the panel in another hand to carry the panels. However, due to the size of such panels, it is difficult for the worker to comfortably grasp the panels while walking. Further, even if one were able to grasp a panel, the panel would likely obstruct the worker's view of their surroundings.

Various panel carrier tools have been devised for making the carrying of such panels more convenient. These tools allow a worker to carry the panels at a lower height by having a hook like mechanism attached to an arm extender. In operation, the hook mechanism supports the lower edge of the panel being carried, and the worker holds onto to a handle attached to the top of the arm extender with one hand and the upper edge of the panel with the other hand to carry the panel.

However, each of the present panel carriers suffers from several crucial design flaws. First, the arm extenders of the panel carriers are not length adjustable. Due to the facts that different workers have varying heights and arm lengths and workers will often carry panels of varying sizes, it would be preferable that the length of the arm extender be adjustable to numerous different settings based on the user's preferences in order to adjust the height of the panel in relation to the worker and the worker's eyes. Further, the present panel carriers are very bulky. Thus, they cannot be carried with the worker conveniently while the worker is not using the panel carrier. As with most tools, it would be preferable that the panel carrier be sized to fit into the worker's pocket or attachable to a tool belt.

Accordingly, it is desirable to provide a compact panel carrier that is easily adjustable to numerous height settings while being able to quickly and securely receive and balance the panel.

SUMMARY

Embodiments of the invention described herein pertain to a panel carrying device including a flexible strap having a first end and a second end and a panel receiving mechanism attached adjacent the second end of the flexible strap. The panel receiving mechanism includes a panel receiving platform for supporting a panel, the panel receiving platform having a proximal end and a distal end and a counterbalancing portion connected to the distal end of the panel receiving platform for assisting in balancing the panel receiving platform during placement and carrying of the panel.

According to some embodiments, the flexible strap is adjustable in length. The panel carrying device may include a handle attached adjacent the first end of the flexible strap. The panel receiving mechanism may include a lip portion connected to the proximal end of the panel receiving platform.

The panel receiving mechanism may be a unitary structure composed at least in part of metal.

In some embodiments, the panel carrying device further includes a first aperture disposed in a top portion of the counterbalancing portion and a second aperture disposed in one of a bottom portion of the counterbalancing portion and the panel receiving platform, and the flexible strap is threaded through the first aperture, through the second aperture, around the counterbalancing portion, and back through the first aperture for attaching the panel receiving mechanism to the flexible strap. In other embodiments, the panel receiving mechanism includes a mast portion connected to a top portion of the counterbalancing portion and the panel carrying further includes a first aperture disposed in the mast portion, a second aperture disposed in the top portion of the counterbalancing portion, and a third aperture disposed in one of a bottom portion of the counterbalancing portion and the panel receiving platform. The flexible strap is threaded through the first, second and third apertures, around the counterbalancing portion, and back through the first aperture for attaching the panel receiving mechanism to the flexible strap.

According to another embodiment of the invention, the panel carrying device includes a flexible strap having a first end and a second end and a panel receiving mechanism attached adjacent the second end of the flexible strap. The panel receiving mechanism includes a panel receiving platform for supporting a panel, the panel receiving platform having a proximal end and a distal end, a counterbalancing portion connected to the distal end of the panel receiving platform for assisting in balancing the panel receiving platform during placement and carrying of the panel, and a plurality of apertures including a first aperture disposed in at least one of a top portion of the counterbalancing portion and a mast portion connected to the top portion of the counterbalancing portion and a second aperture disposed adjacent the distal end of the panel receiving platform. The flexible strap is threaded through first aperture and second aperture for attaching the panel receiving mechanism to the flexible strap.

In yet another embodiment, the panel carrying device includes a flexible strap adjustable in length having a first end and a second end and a panel receiving mechanism attached adjacent the second end of the flexible strap. The panel receiving mechanism includes a panel receiving platform for supporting a panel, the panel receiving platform having a proximal end and a distal end, a counterbalancing portion connected to the distal end of the panel receiving platform and extending remotely from distal end in the opposite direction of the proximal end for assisting in balancing the panel receiving platform during placement and carrying of the panel, and a plurality of apertures including a first aperture disposed adjacent a top portion of the counterbalancing portion and a second aperture disposed adjacent a bottom portion of the counterbalancing portion. The flexible strap is threaded past the top portion through the second aperture, around an apex of the counterbalancing portion, and through the first aperture for attaching the panel receiving mechanism to the flexible strap.

BRIEF DESCRIPTION OF THE DRAWINGS

Further advantages of the invention are apparent by reference to the detailed description in conjunction with the figures.

DETAILED DESCRIPTION

Figure 1:
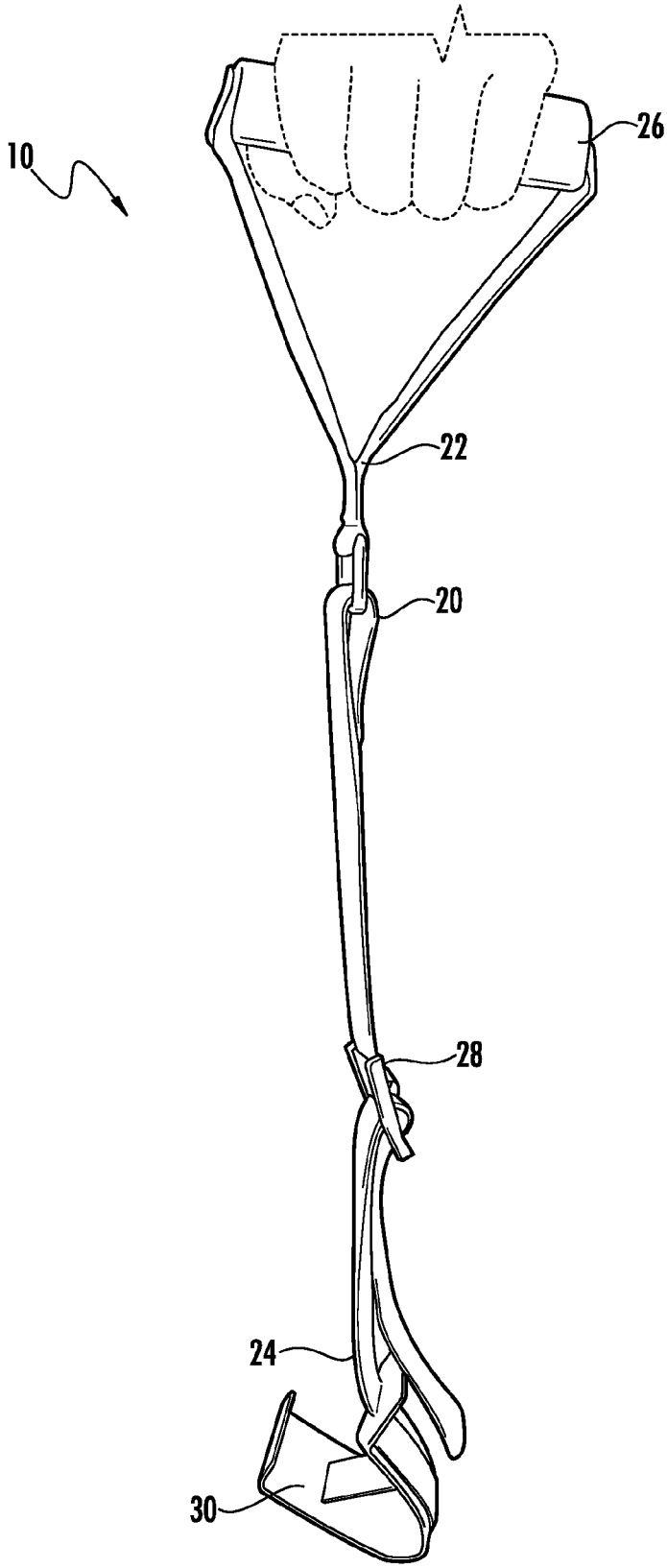
FIG. 1 depicts a panel carrying device according to one embodiment of the invention.
Figure 2:
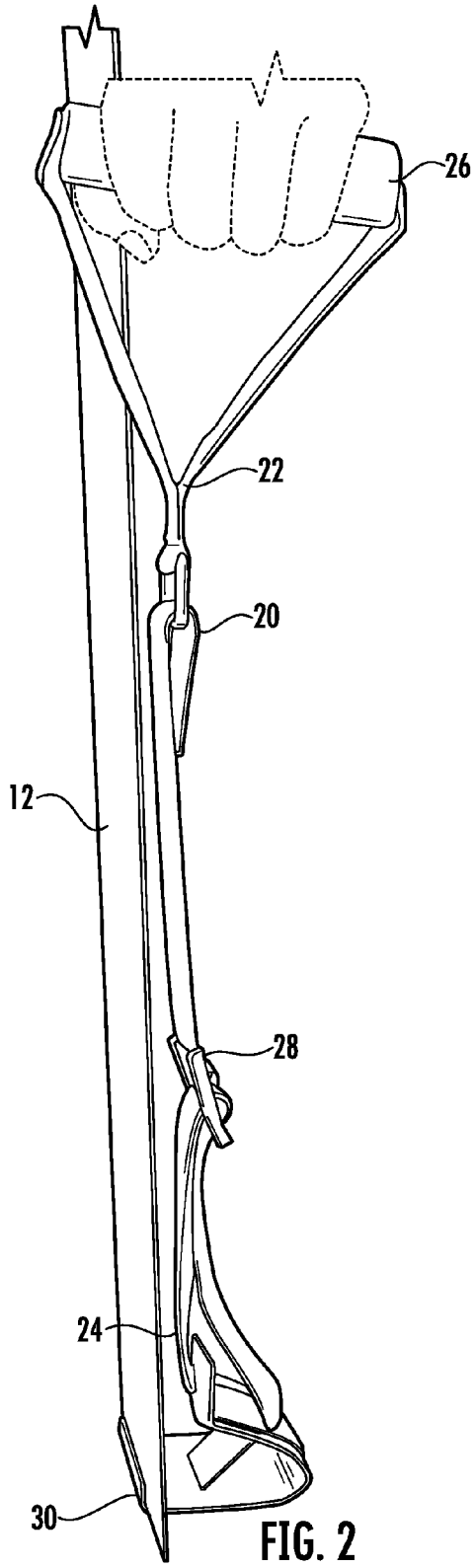
FIG. 2 depicts the panel carrying device as depicted in FIG. 1 while carrying a panel.

Referring to FIGS. 1-2, a panel carrying device 10 is shown having a flexible strap 20 and a panel receiving mechanism 30 for carrying a panel 12. The flexible strap includes a top end 22 and a bottom end 24. A handle 26 is preferably attached adjacent the top end 22 of the strap 20 and the panel receiving mechanism 30 is attached adjacent the bottom end 24. The strap 20 may be any type of flexible, foldable, or bendable material that is susceptible to modification. In preferred embodiments, the strap 20 is a common nylon strap as typically used in items such as leashes, seatbelts, backpacks, etc. Preferably, the strap 20 also includes a strap adjuster or slide 28 so that the length of the strap 20 may be easily adjusted. By using a flexible strap 20 that may be folded, wrapped, bundled, etc. in conjunction with a relatively small panel receiving mechanism 30 as described further below, the panel carrying device 10 is capable of being small enough to be conveniently placed in one's pocket or carried on a worker's tool belt.

Figure 3:
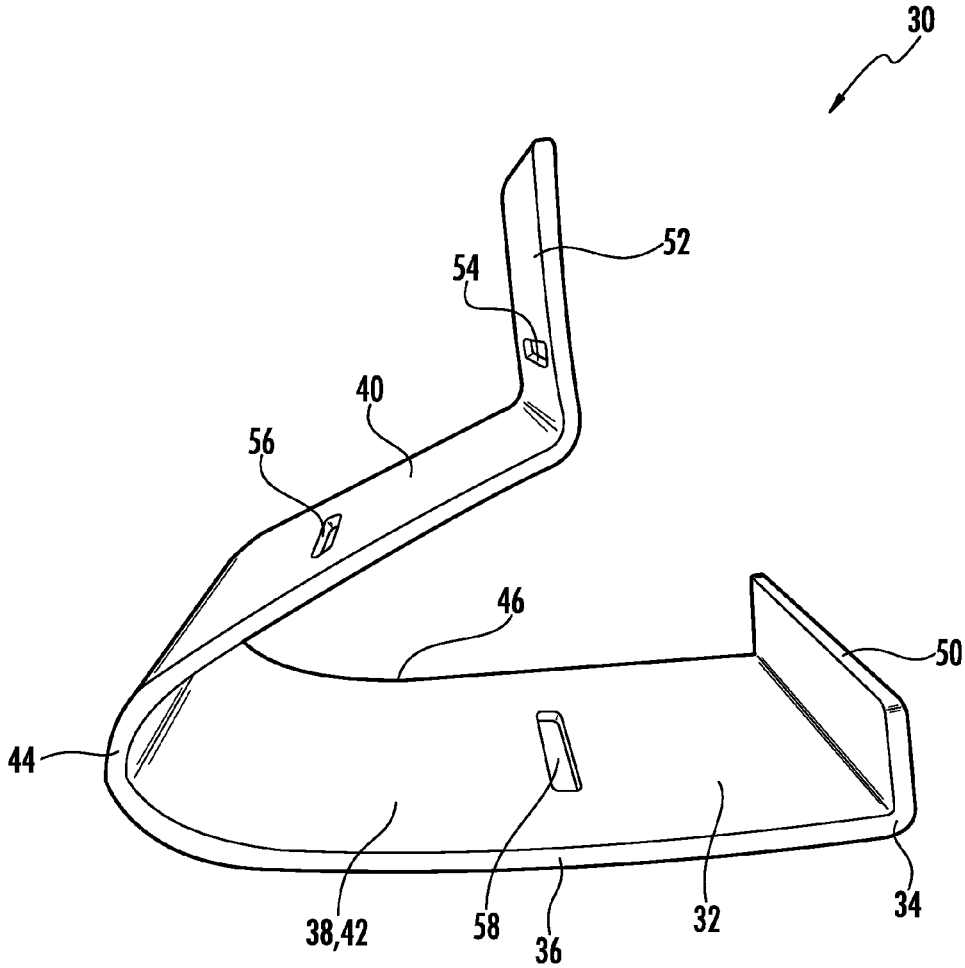
FIG. 3 depicts a perspective view of a panel receiving mechanism according to one embodiment of the invention.

Referring to FIG. 3, the panel receiving mechanism 30 includes a panel receiving platform 32 having a proximal end 34 and a distal end 36. The panel receiving platform 32 is generally horizontal but may be slightly curved to better receive the panel 12. As shown in FIG. 2, during operation of the panel carrying device 10 (i.e., when a worker is using the device 10 to carry a panel 12), the position of the panel receiving platform 32 preferably ranges from a generally horizontal position to a position where the proximal end 34 is disposed on a plane above the distal end 36. Accordingly, in order to prevent the proximal end 34 from being disposed on a plane lower than the distal end 36 of the panel receiving platform 32 due to the flexibility of the flexible strap 20 and the weight of the panel 12, the panel receiving mechanism includes a counterbalancing portion 38 connected to the distal end 36 of the panel receiving platform 32. The counterbalancing portion 38 preferably extends remotely from the distal end 36 of the panel receiving platform 32 in the opposite direction of the proximal end 34 for assisting in balancing and preventing rotation of the panel receiving platform 32 during placement and carrying of the panel 12.

As depicted in the side view according to FIG. 3, the counterbalancing portion 38 is preferably formed into a compressed "C" shape (i.e., bow shaped) having a top member 40 and a bottom member 42 which meet at an apex 44. While the counterbalancing portion 38 of the panel receiving mechanism 30 is shown and described above as being a compressed "C" shape, other configurations are possible and within the scope of the present invention. In other words, the dimensions, configurations, materials used, etc. may all be varied for the counterbalancing portion 38 in relation to the panel receiving platform 32 according to different intended uses of the device such as the size and type of panel 12 intended to be carried and/or how many panels 12 are intended to be carried by the device. For example, if the device 10 is intended to be used with multiple panels 12, it may be desirable to lengthen the panel receiving platform 32. However, by lengthening the panel receiving platform 32, the counterbalancing portion 38 may need to be further extended and/or have an increased weight in order to maintain the horizontal position of the panel receiving platform 32 while carrying the multiple panels 12. Further, the region 46 between the top member 40 and the bottom member 42 may be open, as shown, or may partially or solidly filled with various materials according to a chosen weight for the counterbalancing portion 38.

For further supporting the panel 12 during operation of the device 10, the panel receiving mechanism 30 also preferably includes a lip portion 50 attached to the proximal end 34 of the panel receiving platform 20 and a mast portion 52 attached to the top portion of the counterbalancing portion 38. In alternate embodiments, the mast portion 52 and/or lip portion 50 may be hinged or slidable so that it can be variably positioned based on the number of panels 12 to be received by the device or to move the mast portion 52 and/or lip portion 50 between loading and carrying positions. For example, moving the lip portion 50 and/or mast portion 52 to the loading position would provide a greater length of the panel receiving platform 32 while moving the lip portion 50 and/or mast portion 52 to the carrying position would allow the lip portion 50 and/or mast portion 52 to provide pressure to the panel(s) 12 being carried.

The panel receiving mechanism 30 preferably includes one or more apertures for receiving the strap 20 and attaching the strap 20 to the panel receiving mechanism 30. Similar to the configuration of the counterbalancing portion 38, the number and location of the apertures in the panel receiving mechanism 30 may vary according to various design choices. Importantly, however, the design choices are based on providing a panel carrying device 10 having a flexible strap 20 and compact panel receiving mechanism 30 as described above wherein the strap 20 provides a fulcrum point for the receiving mechanism 30 and threading of the strap through the apertures and around the counterbalancing portion 38 assists in positioning the panel receiving platform 32 into a preferable horizontal position during operation of the device 10.

Figure 4:
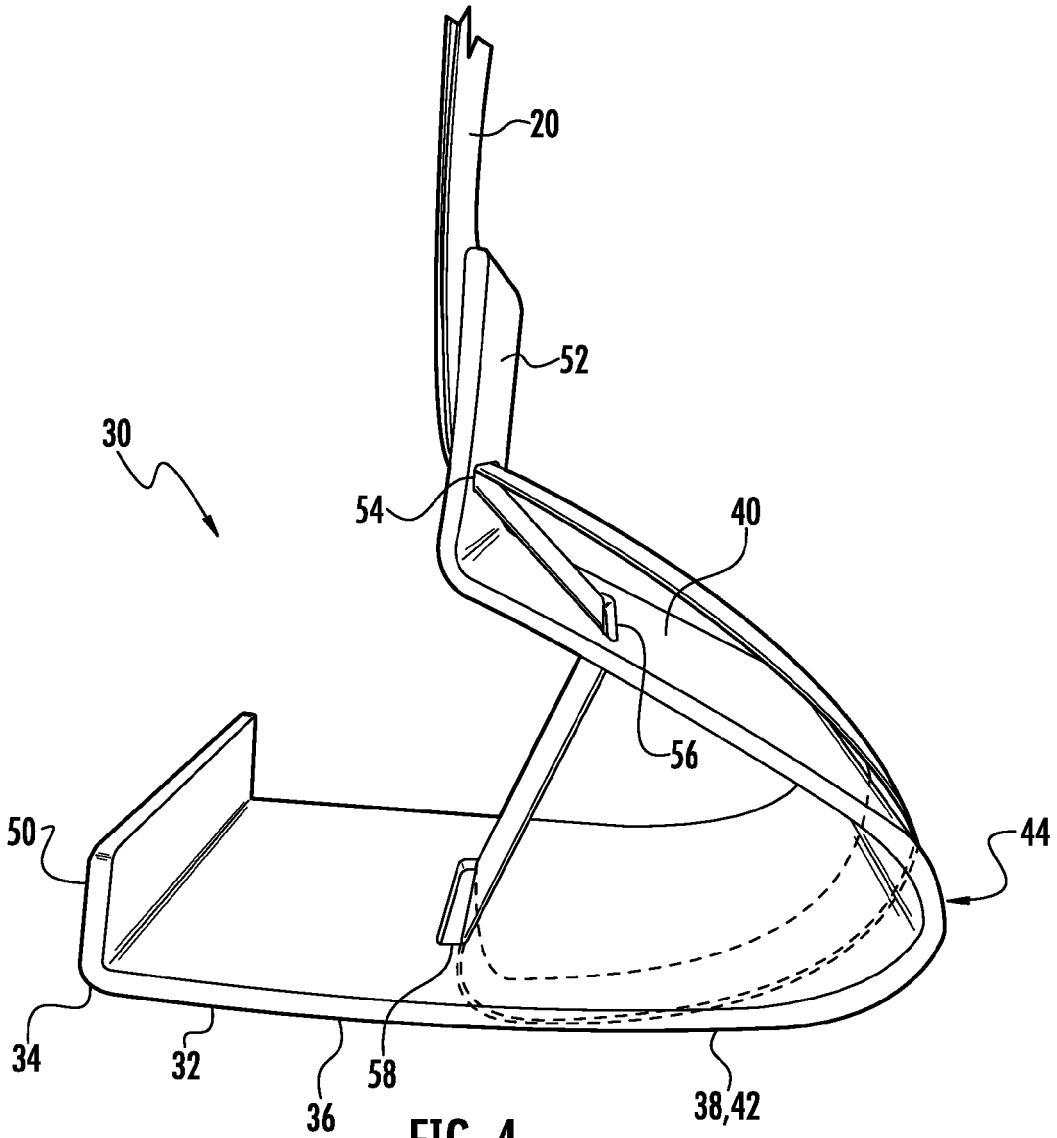
FIG. 4 depicts a side view of a panel receiving mechanism have a flexible strap threaded through a plurality of apertures disposed in the panel receiving mechanism according to one embodiment of the invention.
Figure 5:
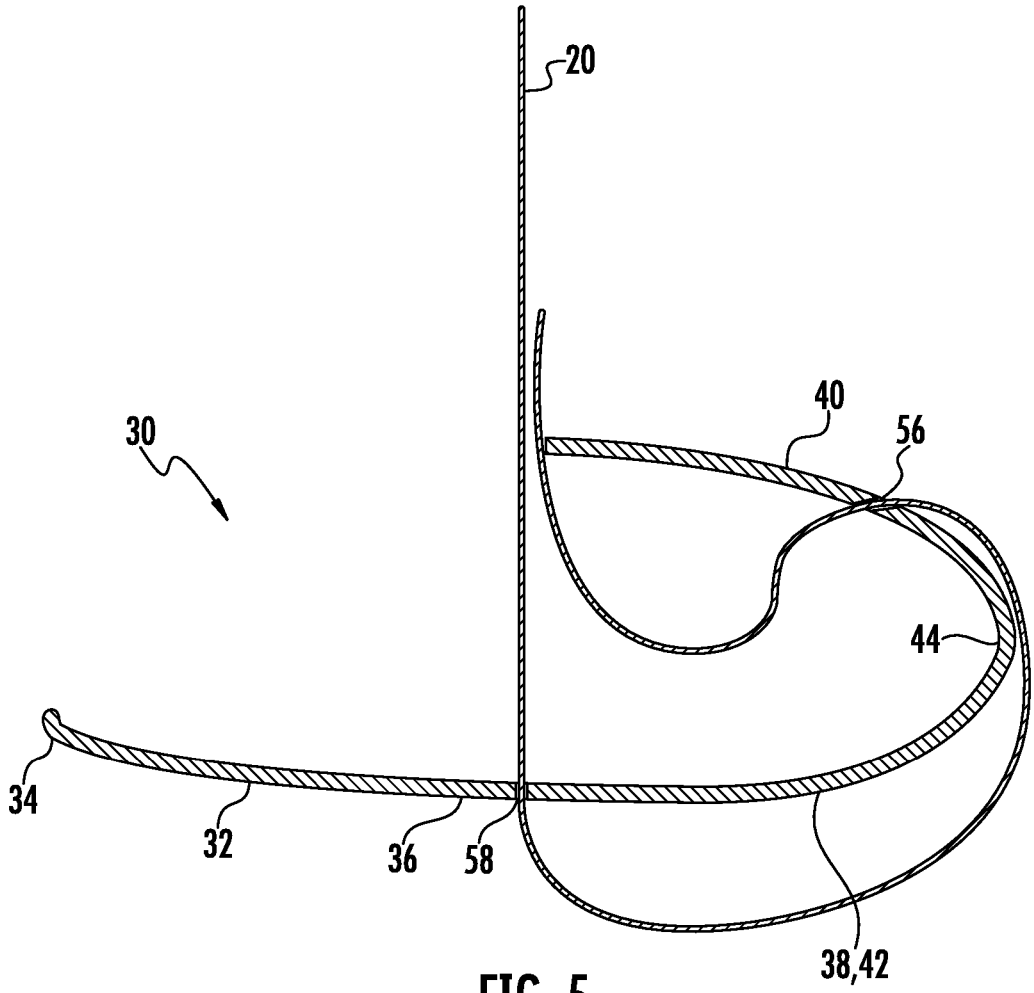
FIG. 5 depicts a side view of a panel receiving mechanism have a flexible strap threaded through a plurality of apertures disposed in the panel receiving mechanism according to another embodiment of the invention.

As shown in the embodiment of FIGS. 3 and 4, the plurality of apertures for receiving the strap 20 includes a first aperture 54 disposed in the mast portion 52, a second aperture 56 disposed in the top portion 40 of the counterbalancing portion 38, and a third aperture 58 disposed in the bottom portion 42 of the counterbalancing portion 38 or adjacent the distal end 36 of the panel receiving platform 32. Referring to FIG. 4, to attach the strap 20 to the panel receiving mechanism 30, the strap 20 is threaded through the first aperture 54, second aperture 56, and third aperture 58, around the apex 44 of the counterbalancing portion 38, and back through the first aperture 54. In a similar embodiment shown in FIG. 5, the panel receiving mechanism 30 has no mast and includes only the second aperture 56 disposed in or adjacent the top portion 40 of the counterbalancing portion 38 and the third aperture 58 disposed in the bottom portion 42. In this embodiment, the strap 20 is threaded down past the top portion 40 and through the third aperture 58, around the apex 44 of the counterbalancing portion 38 and through second aperture 56, and then back up past the top portion 40 to attach the strap 20 to the panel receiving mechanism 30. In further non-limiting alternate embodiments, the strap is threaded only through one of the first aperture 54 or the second aperture 56, with or without lip portion 50 and/or mast portion 52.

By wrapping the flexible strap 20 around the apex 44 of the compressed "C" shaped counterbalancing portion 38 before being threaded back through the first aperture 54 or second aperture 56, the strap 20 stabilizes the panel receiving mechanism 30 and prevents the panel receiving mechanism 30 from rotating during operation of the device 10.

In other features of the invention, the flexible strap 20 allows the panel receiving mechanism 30 to oscillate. The oscillation and configuration of the panel receiving mechanism 30 provides the worker the ability to swing the device in order to easily "hook" the panel 12 before carrying. The configuration of the panel receiving mechanism 30 also allows the panel receiving platform 32 to rest on a ground surface for assisting in panel 12 placement.

In preferred embodiments, the panel receiving mechanism is constructed of a unitary piece of metal such as steel or aluminum. However, the panel receiving mechanism could also be constructed of plastic or even a combination of plastic and metal.

The foregoing description of preferred embodiments for this invention has been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention.

What is claimed is:

1. A panel carrying device comprising:

a flexible strap having a first end for holding the device and a second end; and a hands free panel receiving mechanism attached adjacent the second end of the flexible strap, the panel receiving mechanism including:

a panel receiving platform for supporting a panel, the panel receiving platform having a proximal end and a distal end, and a counterbalancing portion extending horizontally from the distal end of the panel receiving platform for assisting in balancing the panel receiving platform in a substantially horizontal position during placement and carrying of the panel.

2. The panel carrying device according to claim 1 wherein the flexible strap is adjustable in length.

3. The panel carrying device according to claim 1 further comprising a handle attached adjacent the first end of the flexible strap.

4. The panel carrying device according to claim 1 wherein the panel receiving mechanism includes a lip portion connected to the proximal end of the panel receiving platform.

5. The panel carrying device according to claim 1 wherein the panel receiving mechanism is a compact unitary structure dimensioned and configured to fit substantially in a user's pocket.

6. The panel carrying device according to claim 1 further comprising a first aperture disposed in a top portion of the counterbalancing portion and a second aperture disposed in one of a bottom portion of the counterbalancing portion and the panel receiving platform, the flexible strap threaded through the first aperture, through the second aperture, around the counterbalancing portion, and back through the first aperture for attaching the panel receiving mechanism to the flexible strap.

7. The panel carrying device according to claim 1 wherein the panel receiving mechanism includes a mast portion connected to a top portion of the counterbalancing portion.

8. The panel carrying device according to claim 7 further comprising a first aperture disposed in the mast portion, a second aperture disposed in the top portion of the counterbalancing portion, and a third aperture disposed in one of a bottom portion of the counterbalancing portion and the panel receiving platform, the flexible strap threaded through the first, second and third apertures, around the counterbalancing portion, and back through the first aperture for attaching the panel receiving mechanism to the flexible strap.

9. The panel carrying device according to claim 1 wherein the counterbalancing portion is formed into a compressed C shape.

10. A panel carrying device comprising:

a flexible strap having a first end and a second end; and a panel receiving mechanism attached adjacent the second end of the flexible strap, the panel receiving mechanism including:

a panel receiving platform for supporting a panel, the panel receiving platform having a proximal end and a distal end, a counterbalancing portion connected to the distal end of the panel receiving platform for assisting in balancing the panel receiving platform during placement and carrying of the panel, and a plurality of apertures including a first aperture disposed in at least one of a top portion of the counterbalancing portion and a mast portion connected to the top portion of the counterbalancing portion and a second aperture disposed adjacent the distal end of the panel receiving platform, the flexible strap threaded through first aperture and second aperture for attaching the panel receiving mechanism to the flexible strap.

11. The panel carrying device according to claim 10 wherein the flexible strap is adjustable in length.

12. The panel carrying device according to claim 10 further comprising a handle attached adjacent the first end of the flexible strap.

13. The panel carrying device according to claim 10 wherein the panel receiving mechanism includes a lip portion connected to the proximal end of the panel receiving platform.

14. The panel carrying device according to claim 10 wherein the panel receiving mechanism is a unitary structure composed at least in part of metal.

15. The panel carrying device according to claim 10 wherein the panel receiving mechanism includes the mast portion connected to the top portion of the counterbalancing portion.

16. The panel carrying device according to claim 15 further wherein the first aperture is disposed in the mast portion and the panel receiving mechanism further includes a third aperture disposed in the top portion of the counterbalancing portion, the flexible strap threaded through the first, second and third apertures, around an apex of the counterbalancing portion, and back through at least one of the first aperture and third aperture for attaching the panel receiving mechanism to the flexible strap.

17. A panel carrying device comprising:

a flexible strap adjustable in length having a first end and a second end; and a panel receiving mechanism attached adjacent the second end of the flexible strap, the panel receiving mechanism including:

a panel receiving platform for supporting a panel, the panel receiving platform having a proximal end and a distal end, a counterbalancing portion connected to the distal end of the panel receiving platform and extending remotely from the distal end in the opposite direction of the proximal end for balancing a weight of the panel supported by the panel receiving platform, and a plurality of apertures including a first aperture disposed adjacent a top portion of the counterbalancing portion and a second aperture disposed adjacent a bottom portion of the counterbalancing portion, the flexible strap threaded through the second aperture, around an apex of the counterbalancing portion, and through the first aperture for attaching the panel receiving mechanism to the flexible strap.

18. The panel carrying device according to claim 17 wherein the panel receiving mechanism is a unitary structure composed at least in part of metal.

19. The panel carrying device according to claim 17 wherein the panel receiving mechanism includes a mast portion connected to the top portion of the counterbalancing portion.

20. The panel carrying device according to claim 9 wherein the counterbalancing portion includes a top member and a bottom member connected at an apex.

* * * * *